United States Patent [19]

Murphy

[11] 3,945,402

[45] Mar. 23, 1976

[54] LAMINAR FLOW PIPE SYSTEM

[76] Inventor: Peter J. Murphy, 108 Clover Lane, Ithaca, N.Y. 14850

[22] Filed: Oct. 25, 1974

[21] Appl. No.: 518,035

[52] U.S. Cl. ..... 138/37; 138/41; 138/42; 138/44; 137/1; 137/8

[51] Int. Cl.[2] ..... F15D 1/02; F15D 1/06

[58] Field of Search ..... 138/37, 41, 42, 44; 137/1, 137/8, 842

[56] References Cited

UNITED STATES PATENTS

| | | | |
|---|---|---|---|
| 2,631,242 | 4/1953 | Metcalf | 73/194 E |
| 3,353,564 | 11/1967 | Bergeijk et al. | 138/41 |
| 3,468,322 | 9/1969 | Katzer | 138/42 X |
| 3,846,229 | 11/1974 | Kallmes | 138/42 X |

*Primary Examiner*—Richard E. Aegerter
*Assistant Examiner*—James E. Bryant, III
*Attorney, Agent, or Firm*—Brooks Haidt Haffner & Delahunty

[57] ABSTRACT

A pipe system for conveying fluids having a straight pipe section with a Reynolds number exceeding 2200 by reason of the critical values of interior surface roughness of the pipe and of turbulence at the pipe section inlet, such values being defined, respectively, by the formulae:

$$(e/d)\ R \lessgtr 200$$

and $$(U/\overline{V})\ R^{1.67} \lessgtr 3500$$

4 Claims, 3 Drawing Figures

LAMINAR FLOW PIPE SYSTEM

The present invention relates to pipe systems for conveying fluids, such as air, gas, water, oil, etc., from one place to another, and particularly to such a system in which the fluid flow is laminar.

It is well-known in the art that laminar flow transport of fluid is desirable for several reasons. For example, the frictional losses at high flow rates are much smaller with laminar flow than with turbulent flow, and therefore, the pumping energy is less, there is less fluid heating, the pumping pressure is lower, and the piping need not be so strong. Furthermore, because there is a lower heat transfer rate between the fluid and the pipe, less heat is transferred between the surroundings and the fluid when temperature differences are present. Also, with laminar flow, the fluid flow noise is lower than with turbulent flow.

A dimensionless number, known as the Reynolds number, is a descriptive measure of fluid flow in a pipe and is defined as follows:

$$R = p\,\overline{V}\,d/\mu$$

where $p$ is the density of the fluid, $\mu$ is the viscosity of the fluid, $\overline{V}$ is the mean axial velocity of the fluid, and d is the internal diameter of the pipe. It is known in the art that when the Reynolds number is less than about 2200 the fluid flow in a pipe will be laminar and that at some higher number, depending on several factors, the fluid flow will be turbulent. Scientists have believed for some time that laminar flow at higher Reynolds numbers, e.g., as high as 100,000, is possible in pipe entrance regions. However, the fact that the Reynolds number is high at the entrance region provides no assurance that the Reynolds number of a practical fluid conveying system is also attainable. In fact, in engineering practice, when the Reynolds number is greater than 2200, the fluid flow in a pipe is turbulent.

It is known in the art that many factors affect the type of flow in a pipe. In order to prevent convective currents that lead to turbulence, the fluid in a horizontal pipe is required to have a density in the upper portion of the pipe no greater than that in the lower portion thereof. If the fluid is heated, this is accomplished by greater insulation at the top of the pipe than at the bottom thereof. In order to prevent curvature currents that increase the frictional losses in the pipe, the pipe should be as straight as possible, but if bends are necessary and if it is desired to prevent such losses, the radius of curvature must be at least equal to:

$$\gamma = \text{pipe diameter} \times R^2/200.$$

To prevent the internal roughness of the pipe from causing turbulence, the internal surface finish, the joint gaps and fittings must be quite smooth, but no criterion concerning the required smoothness has been developed. Finally, to prevent the turbulence that is in the fluid as it enters the pipe from bringing about turbulence in the entire pipe, the turbulence level in the entering fluid must be small, but again the required level has not been known. Although the methods for reducing internal surface roughness of pipe walls and turbulence levels in fluids to desired quantities are known in the art, the inner wall roughness and inlet fluid turbulence level criteria which permit the practical use of high Reynolds number laminar flows have previously been unknown.

After making a study and a series of experimental investigations, I have found that by using the usual features of a pipe system and by, in addition, properly relating the internal roughness of the pipe and the fluid turbulence at the inlet of the pipe to the Reynolds number, laminar flows can be obtained consistently at higher values of the Reynolds number than the usual 2200, e.g., 20,000 and higher. In accordance with the invention, the readily available pipe is selected and finished internally, and both the fixed joints and the expansion joints between sections of pipe are constructed so that the internal roughness is such that $$(e/d)\,R \lesssim 200$$

where $e$ is the root mean square height of the roughness of the internal surface of the pipe, $d$ is the internal diameter of the pipe, and R is the Reynolds number. In addition, by the use of conventional apparatus, e.g., screens, tapered inlet sections, wall suction, etc., the fluid turbulence at the pipe inlet is controlled so that $$(U/\overline{V})\,R^{1.67} \lesssim 3500$$

where U is the cross-section average of $V'$, $\overline{V}$ is the cross-section average of $V''$, R is the Reynolds number, $V'$ is the root mean square time average of $(V - V'')$, $V''$ is the time average of V, and V is the axial velocity of the fluid in the pipe.

One object of the invention is to permit consistent construction of pipe systems for fluid transport which will have laminar flow at Reynolds number much higher than 2200.

Another object of the invention is to permit economical transport of fluids by pipe with low frictional losses.

An additional object of the invention is to permit economical pipe transport of heated or cooled fluids with low heat transfer rates.

A still further object of the invention is to permit quiet pipe transport of fluids.

Other objects and advantages of the invention will be apparent from the following detailed description of the presently preferred embodiment thereof, which description should be considered in conjunction with the accompanying drawings, in which.

Figure 1:
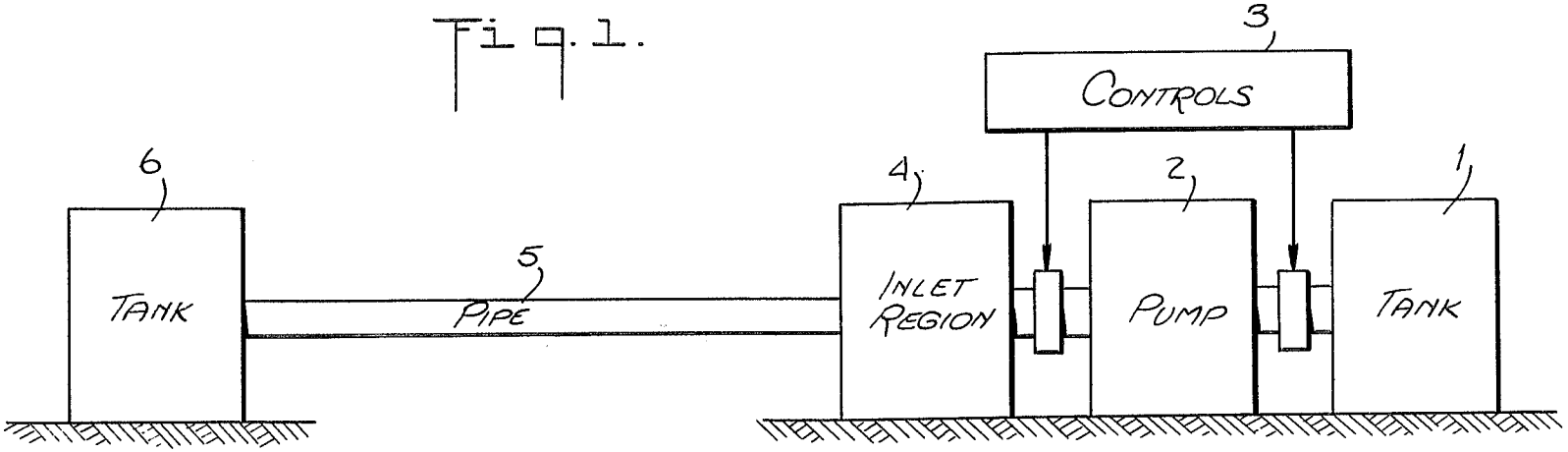
FIG. 1 is a diagrammatic, elevation view of a typical transport system incorporating the invention.

FIG. 1 illustrates diagrammatically a typical fluid transport system comprising an initial vessel 1 for the fluid which is pumped from the vessel 1 by a pump 2 through a typical set of controls 3 and through a known type fluid turbulence control means 4 and into a series of connected pipes 5. The fluid passes through the pipes 5 to a receiving vessel 6. The initial vessel 1 and the receiving vessel 6 are common fluid containing vessels, e.g., storage tanks, process chambers, machines, etc. The pump 2 and the flow controls 3 are those typically used in pumping systems, e.g., centrifugal pumps, control valves, emergency valves, surge tanks, etc. The pipes 5 and the fluid turbulence control means 4 are common, smooth-inner-wall pipe and known fluid turbulence reduction means, respectively. The methods of selecting, joining and finishing the pipe so that its inner wall roughness meets the necessary roughness limitations are well-known in the art. While the invention will be described in conjunction with the system illustrated in FIG. 1, it will be apparent to those skilled in the art that the principles of the invention may be applied to other systems, i.e., systems in which the pumps and tanks are omitted.

Figure 2:
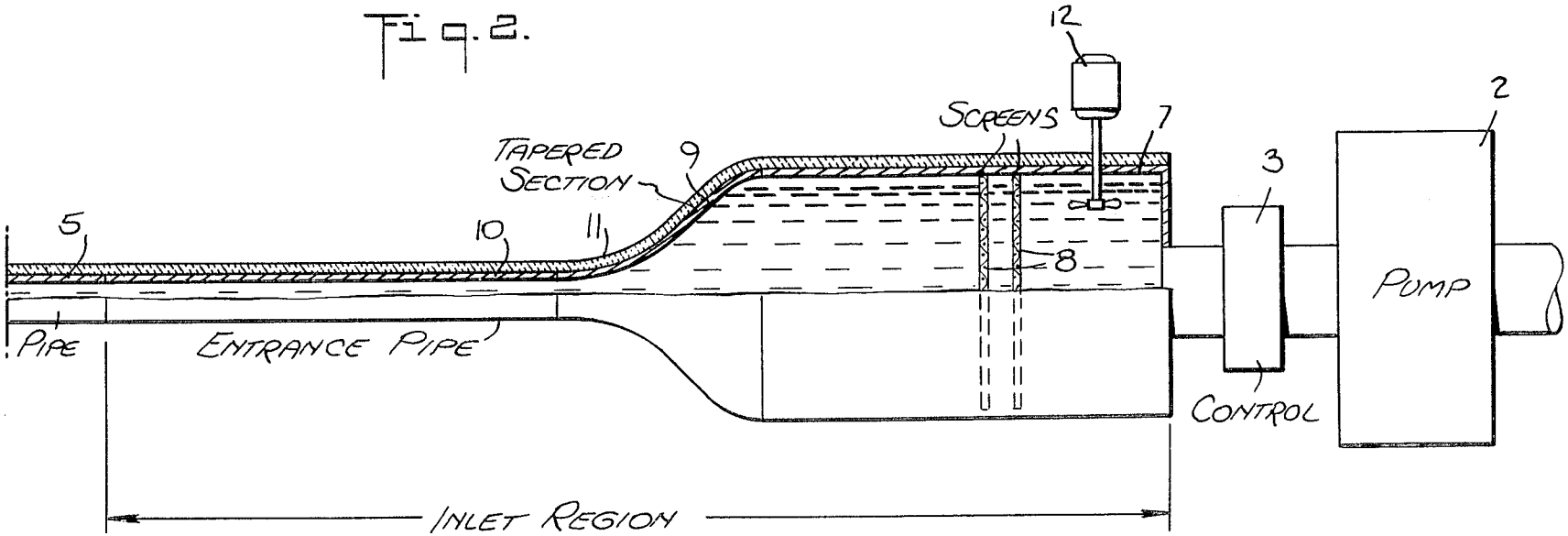
FIG. 2 is a diagrammatic, partial sectional view of one form of inlet fluid turbulence control means which may be used in the system shown in FIG. 1.

FIG. 2 illustrates a typical combination of fluid turbulence control means which are well-known in the art of turbulence control. It comprises a large hollow section 7 through which the turbulent fluid from the pumps 2 passes, a plurality of screens 8 of small mesh size located perpendicular to the flow direction and within the section 7, a tapered section 9 which gradually reduces in cross-section from that of section 6 to that of the pipe 5 and through which the fluid from section 6 passes, and a section of entrance pipe 10 of the same diameter as the pipe 5. The tapered section 9 and the entrance pipe 10 are selected, joined and finished so that their inner wall roughness meets the limitations known in the art of boundary layer stability. The diameter and length of the large hollow section 7 and the number, spacing and mesh size of the screens 8 and the shape of the tapered section 9 can all be determined in accordance with the art so that the inlet fluid turbulence at the end of the pipe 10, where the fluid has a parabolic velocity profile, meets the necessary fluid turbulence limitations. While FIG. 2 illustrates one type of inlet fluid turbulence control means, it will be apparent to those skilled in the art that other types of means, e.g., wall suction, may be employed for reducing the inlet fluid turbulence to any desired level.

As mentioned hereinbefore, in order to prevent convective currents when the fluid has a temperature higher than that of the surroundings, the inlet section 7, the tapered section 9, and the pipes 5 and 10 may have insulation 11 at the upper half thereof. Also, to prevent temperature differences cross-wise of the inlet section 7, motor driven mixers 12 may be employed.

The inner wall roughness and the inlet fluid turbulence level required to permit the practical use of high Reynolds number laminar flow have been determined from the data of a series of experiments. In these experiments, the inner wall roughness and the inlet fluid turbulence levels were determined by measurements and calculations well-known in the art.

The determination of the value of the inlet fluid turbulence level cannot be made directly by techniques well-known in the art. Although techniques for the measurement of fluid turbulence levels are well-known in the art, some of them being described in the book entitled TURBULENCE by J. O. Hinze, published in 1950 by McGraw-Hill, particularly pages 75–83 thereof, the turbulence level at the end of the inlet region of the pipe referred to in the invention is too small to be measured by these techniques. Thus, it is necessary to measure the turbulence level within the inlet region, where it has sufficient amplitude to be measurable, and use calculations well-known in the art to determine its level at the end of the inlet section. To confirm this procedure, measurements were made using turbulence generators located at the end of the inlet region. These measurements confirmed the calculated values, and so the turbulence level at the end of the inlet region could be determined indirectly. The turbulence level at the end of the inlet region is quantified by the cross-section average, U, of the root mean square time average, V′, of the difference (V − V″), between the instantaneous stream-wise velocity, V, and its time average, V″.

The determination of the value of the roughness level of the inner wall of the pipe can be carried out by techniques well-known in the art and examples of such techniques are set forth in the book entitled INDUSTRIAL INSPECTION METHODS by Leno C. Michelon, published in 1950 by Harper, particularly pages 500–503 thereof. The roughness is quantified by the root mean square height, e, of the roughness of the inner surface of the pipe.

In one group of experiments using very smooth pipe, the inlet fluid turbulence level was varied by using turbulence generators located at the beginning and at the end of the inlet region, and it was determined that to obtain laminar flow, the fluid turbulence level, U, at the end of the inlet region should be less than that determined from the following formula:

$$U = M\,\overline{V}\,R^{-1.67}$$

where $U$ is the cross-section average of $V'$, $\overline{V}$ is the cross-section average of V″, V′ is the root mean square time average of (V − V″), V″ is the time average of V, V is the axial velocity of the fluid in the pipe, $R$ is the Reynolds number, and M is equal to 3500.

In another group of experiments using very low inlet fluid turbulence levels, the roughness of the inner wall of the pipe was varied and it was found that to obtain laminar flow the inner wall roughness, $e$, should be less than that determined from the following formula:

$$e = K\,d/R$$

where $e$ is the root mean square height of the roughness of the inner surface of the pipe, $d$ is the interior diameter of the pipe, $R$ is the Reynolds number, and $K$ is equal to 200.

Figure 3:
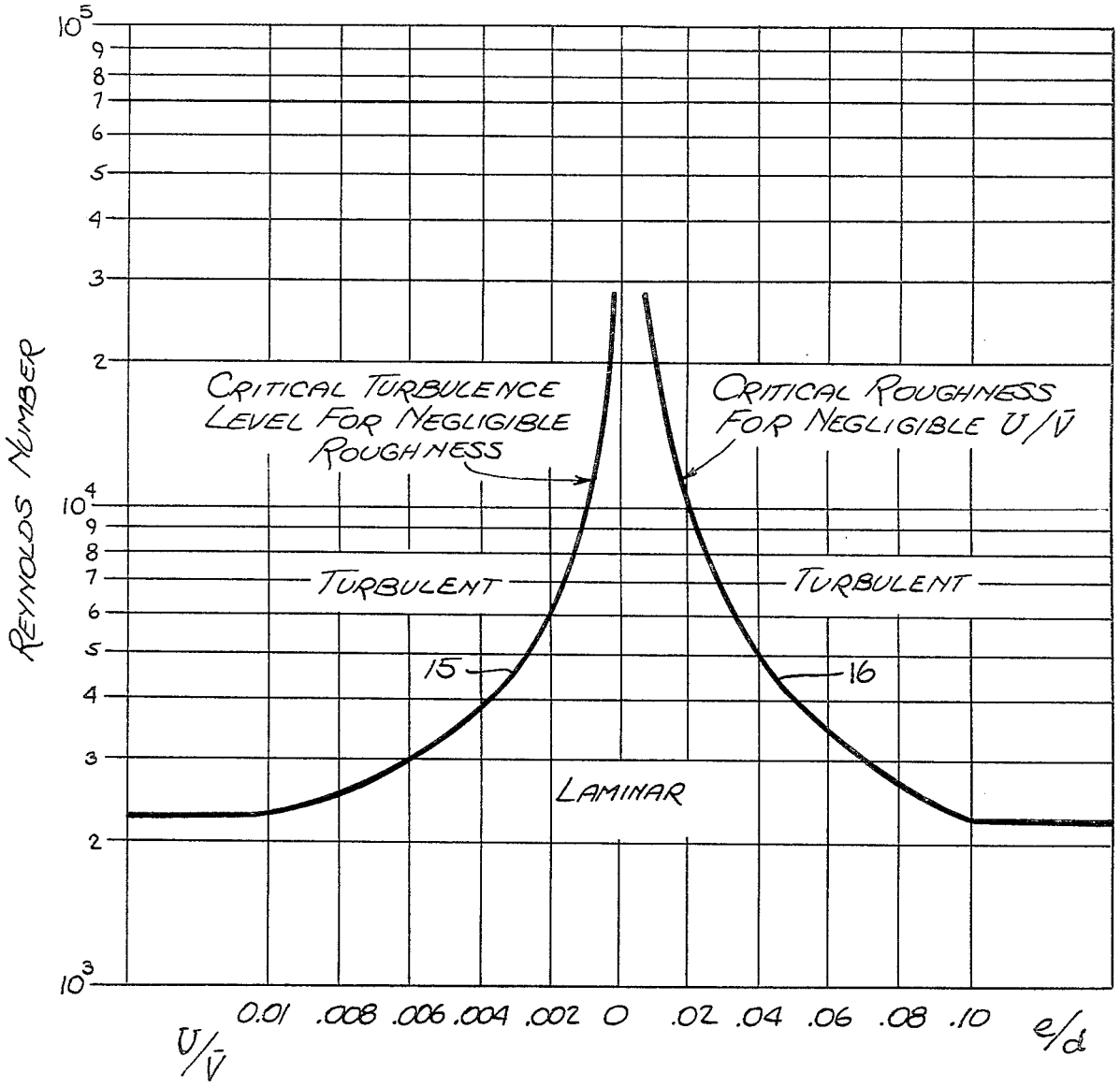
FIG. 3 is a graph illustrating the effect of inlet fluid turbulence and pipe interior surface roughness on the Reynolds number in a pipe fluid transport system incorporating the invention.

FIG. 3 is a graph illustrating the inner wall roughness and inlet fluid turbulence permitted in using high Reynolds number laminar pipe flow in a practical pipe system. The left-hand curve 15 indicates the maximum values of $U/\overline{V}$ for laminar flow when the roughness is negligible, i.e., $e/d$ is less than $20R^{-1}$, and the right-hand curve 16 indicates the maximum values of $e/d$ for laminar flow when $U/\overline{V}$ is negligible, i.e., $U/\overline{V}$ is less than $350R^{-1.67}$. For a selected Reynolds number, curves 15 and 16 will indicate a value of inner wall roughness and a value of inlet fluid turbulence for laminar flow, i.e., a pipe system using the given Reynolds number must have less inner wall roughness and less inlet fluid turbulence than those values determined from the curves 15 and 16.

Good engineering practice indicates that, due to the random nature of the roughness and the turbulence and due to the accuracy of the techniques of the art of measuring these quantities, a safety factor should be used. Roughness and turbulence levels are normally determined by measuring those properties for a few representative sample locations. There exists a certain probability that the values measured do not represent the true levels. Further, the measurement techniques themselves, especially those of turbulence level, involve uncertainty. The safety factor should preferably be about 2, and therefore, in the turbulence and roughness formulae, M would be 1750 and K would be 100.

As an example illustrating the results obtained in utilizing a pipe system designed according to the present invention, a pipe having an internal diameter of 2.2 cm. was used to convey air from one place to another, using a small industrial blower and inlet fluid turbulence control means. The pipe was extruded aluminum, and it was finished and installed so that its maximum inner wall roughness was 0.1 mm. The control means consisted in a cardboard cylinder of 50 cm. diameter and 120 cm. length, three common window screens spaced 30 cm. apart within the cylinder, a molded fiber-glass tapered section, and an entrance pipe 24 m. long and 2.2 cm. in diameter. The entrance pipe and the tapered section were installed so that their maximum inner wall roughness was 0.05 mm. The dimensions of the tapered section were as follows:

| Distance from end - cm. | Internal Radius cm. |
|---|---|
| 0 | 25 |
| 10 | 17.7 |
| 20 | 9.4 |
| 30 | 5.8 |
| 40 | 4.0 |
| 50 | 2.9 |
| 60 | 2.2 |
| 70 | 1.77 |
| 80 | 1.51 |
| 90 | 1.32 |
| 100 | 1.21 |
| 110 | 1.14 |
| 125 | 1.10 |

The inlet fluid turbulence level was measured indirectly and determined to be $$U/\overline{V} = 10^{-4}.$$

This system provided laminar flow for all Reynolds numbers below 20,000. It was not possible with the blower available to determine the upper limit of possible Reynolds numbers. This system transported the air with frictional losses one sixth the amount that would be required to transport the same quantity of air in the same pipe using turbulent flow, with the corresponding reductions in pumping energy, fluid heating and pumping pressure.

Although a preferred embodiment of the present invention has been described and illustrated, it will be understood by those skilled in the art that various modifications may be made without departing from the principles of the invention.

What is claimed is:

1. A fluid conveying system having laminar fluid flow and a Reynolds number in excess of 2200, comprising a straight pipe of circular cross-section having an inlet and outlet, and fluid turbulence control means connected to said inlet for supplying said fluid to said inlet, said pipe having an internal roughness determined from the formula:

$$(e/d)\ R \lessapprox 200$$

where $e$ is the root mean square height of the roughness of the internal surface of the pipe, $d$ is the internal diameter of the pipe, and R is the Reynolds number, and wherein said fluid turbulence control means is of a form in which the turbulence level of said fluid at said inlet conforms to the formula:

$$(U/\overline{V})R^{1.67} \lessapprox 3500$$

where U is the cross-section average of V′, V′ is the root mean square time average of $(V - V'')$, V″ is the time average of V, V is the axial velocity of the fluid, $\overline{V}$ is the cross-section average of V″, and R is the Reynolds number.

2. A fluid conveying system as set forth in claim 1, wherein $$(e/d)\ R \lessapprox 100$$

and $$(U/\overline{V})\ R^{1.67} \lessapprox 1750$$

3. A fluid conveying system as set forth in claim 1, in which the fluid turbulence control means are a large diameter tube, a plurality of screens in said tube, a tapered transition section with a smooth inner wall connected to said tube and a straight entrance pipe of circular cross-section with a smooth inner wall connected to said transition section.

4. A fluid conveying system as set forth in claim 1, in which the fluid is hotter than its surroundings and in which the fluid turbulence control means are a large diameter tube insulated in its upper half, a plurality of fluid mixers within said tube, a plurality of screens in said tube located downstream of the mixers within said tube, a tapered insulated transition section with a smooth inner wall connected to said tube, and an entrance pipe with a smooth inner wall and with insulation on its upper half, connected to said transition section, and in which the straight pipe of circular cross-section is insulated in its upper half.

* * * * *